United States Patent [19]

Dalton, Jr.

[11] Patent Number: 4,545,168

[45] Date of Patent: Oct. 8, 1985

[54] INTERCONNECTING WALL PANELS

[75] Inventor: Robert F. Dalton, Jr., High Point, N.C.

[73] Assignee: Alma Desk Company, High Point, N.C.

[21] Appl. No.: 596,262

[22] Filed: Apr. 3, 1984

[51] Int. Cl.[4] ..... E04B 2/82

[52] U.S. Cl. ..... 52/588; 52/36; 52/239; 52/586

[58] Field of Search ..... 52/588, 36, 238.1, 239, 52/241, 275, 278, 281, 286, 287, 458, 563, 578, 582, 586, 585, 591, 593, 594, 126.3

[56] References Cited

U.S. PATENT DOCUMENTS

| | | | |
|---|---|---|---|
| 3,486,287 | 12/1969 | Guillon | 52/239 |
| 3,766,696 | 10/1973 | Totoonchie | 52/241 |
| 3,877,191 | 4/1975 | Munsey | 52/632 |
| 3,971,182 | 7/1976 | Donahue et al. | 52/282 |
| 4,100,709 | 7/1978 | Good | 52/239 |
| 4,103,465 | 8/1978 | McDonald | 52/586 X |
| 4,104,838 | 8/1978 | Hage et al. | 52/239 |
| 4,144,681 | 3/1979 | Leffler et al. | 52/127 |
| 4,269,005 | 5/1981 | Timmons | 52/36 |
| 4,497,148 | 2/1985 | Lopez | 52/126.3 |

FOREIGN PATENT DOCUMENTS

| | | | |
|---|---|---|---|
| 424164 | 5/1967 | Switzerland | 52/586 |

OTHER PUBLICATIONS

Alma Desk Company—AD/Alma Open Plan Office System Installation Instructions.

*Primary Examiner*—J. Karl Bell

*Attorney, Agent, or Firm*—Bell, Seltzer, Park & Gibson

[57] ABSTRACT

Modular wall panels are provided which are interconnected by pairs of upper and lower side connectors and which are rigidly interconnected together in substantial alignment to form a wall construction. The wall panels are provided with a vertically arranged bracket supporting means adapted for receiving brackets and accompanying shelves or furnishings at desired locations.

14 Claims, 11 Drawing Figures

INTERCONNECTING WALL PANELS

FIELD OF THE INVENTION

This invention relates to a wall panel for interconnection with other correspondingly constructed wall panels to form walls and space enclosures of predetermined size and arrangement. More particularly, this invention is directed to wall panels which are interconnected by pairs of upper and lower side connectors and which are rigidly interconnected together in substantial alignment.

BACKGROUND OF THE INVENTION

It has become popular to utilize modular wall panels to form walls and space enclosures of desired size and arrangement in offices, work areas, schools and the like. Such panels may be formed of sound absorbing material and covered with a variety of decorative surfaces. Furthermore, as space needs change, the formed walls may be dismantled and the wall panels rearranged to form new walls and wall arrangements better suited to the changed space needs.

These modular walls, however, have heretofore suffered various deficiencies. In particular, such walls formed of interconnecting wall panels have typically not been very sturdy and indeed have exhibited but a fraction of the stability and rigidity of conventional permanent interior building walls. Much of this lack of rigidity has been caused by the absence of truly stable interconnections between the modular panels. And the requirement that the panel interconnections be able to be readily undone and the panels disconnected has contributed to this lack of rigidity. Furthermore, this absence of stability at the areas of panel interconnection has been particularly undesirable since it has been desirable to suspend work surfaces, shelves and the like from supports at these interconnection junctures.

There have been attempts made to improve the means of interconnection such as including separate connection posts between the panels but none of these have yielded truly satisfactory results. Most of these attempts have instead involved the use of unduly complicated and expensive apparatus which have interfered with the goal of having a wall system capable of being readily and easily assembled, disassembled and rearranged. These attempts have also presented problems with panel alignment and wall rigidity.

SUMMARY OF THE INVENTION

The present invention overcomes the above disadvantages by providing wall panels with upper and lower side connectors adapted to interconnect with counterpart connectors of corresponding adjacent wall panels in a secure and stable manner to form walls of desired predetermined size and arrangement.

Another object of the invention is to provide wall panels with upper and lower side connectors wherein the upper and lower connectors on each side are symmetrically disposed along a vertical line passing through the midpoint of each respective side so that they serve to ensure that the vertical faces of adjacent wall panels will be in substantial alignment when the wall panels are assembled to form a wall.

Another object of the invention is to provide wall panels with channels along the opposite vertical sides of the panels for receiving and positioning the upper and lower connectors.

Another object of the invention is to provide wall panels having vertically arranged bracket supporting means which have a series of vertically spaced openings therein for receiving shelf and fixture supporting brackets at a variety of locations.

Another object of the invention is to provide wall panels having readily accessible fastener means at the upper connectors for rigidly interconnecting adjoining wall panels and wherein the fastener means can be readily tightened and loosened by hand.

BRIEF DESCRIPTION OF THE DRAWINGS

Further and more specific objects and advantages of the invention will become more apparent as the description proceeds, when taken in connection with the accompanying drawings, in which.

DETAILED DESCRIPTION OF THE INVENTION

While the present invention will be described more fully hereinafter with reference to the accompanying drawings, in which particular embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
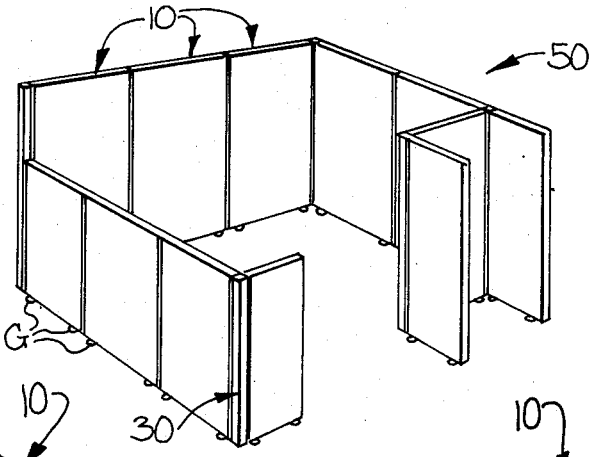
FIG. 1 is schematic isometric view showing a wall construction formed by the wall panels of the invention.

Referring now more specifically to the drawings, FIG. 1 shows generally how a plurality of correspondingly constructed wall panels 10 of the invention may be positioned and interconnected to form a wall and a wall construction 50 of desired predetermined shape and arrangement.

Figure 2:
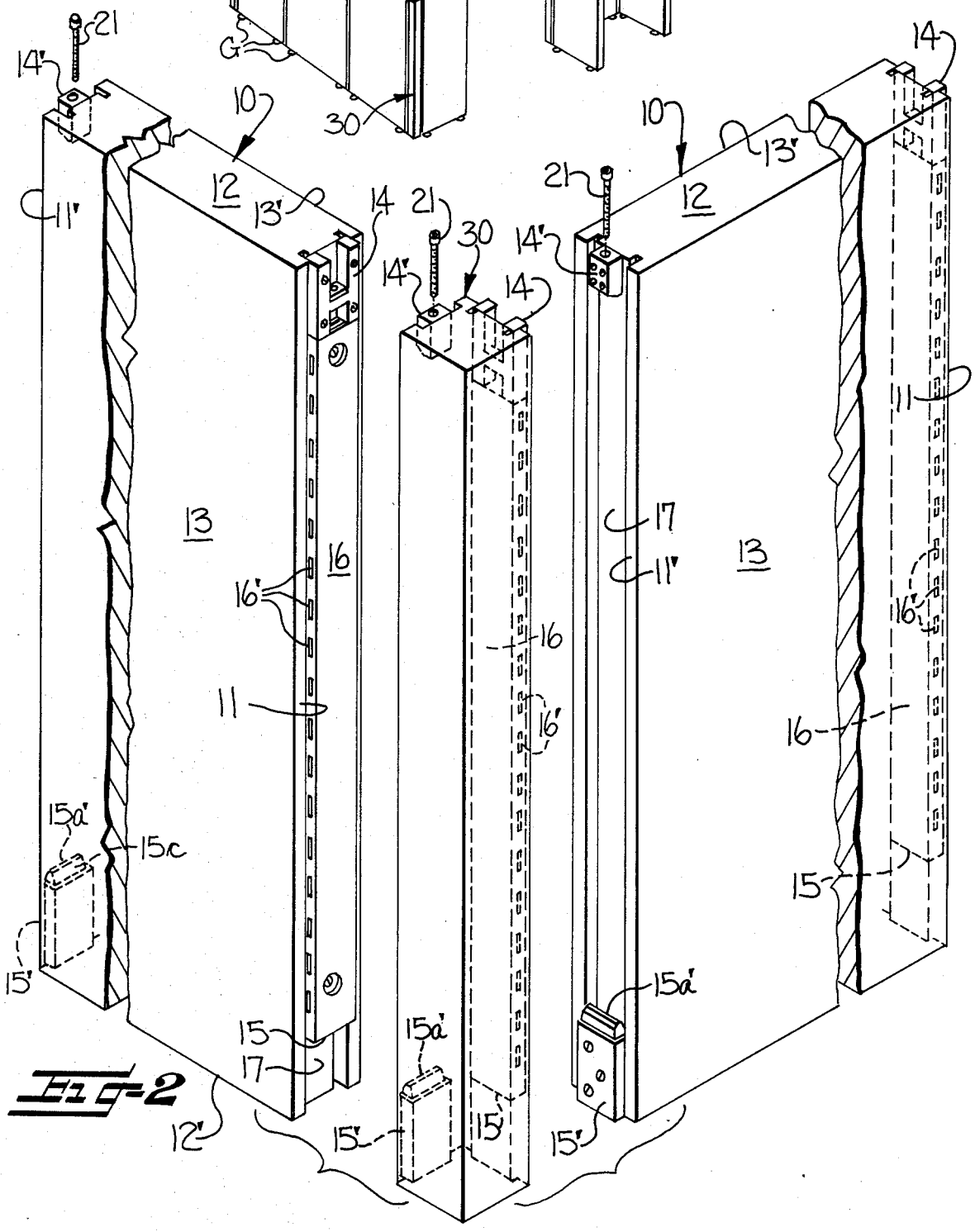
FIG. 2 is an exploded isometric view showing how the wall panels of the invention are connected at a corner wall construction.
Figures 3, 4:
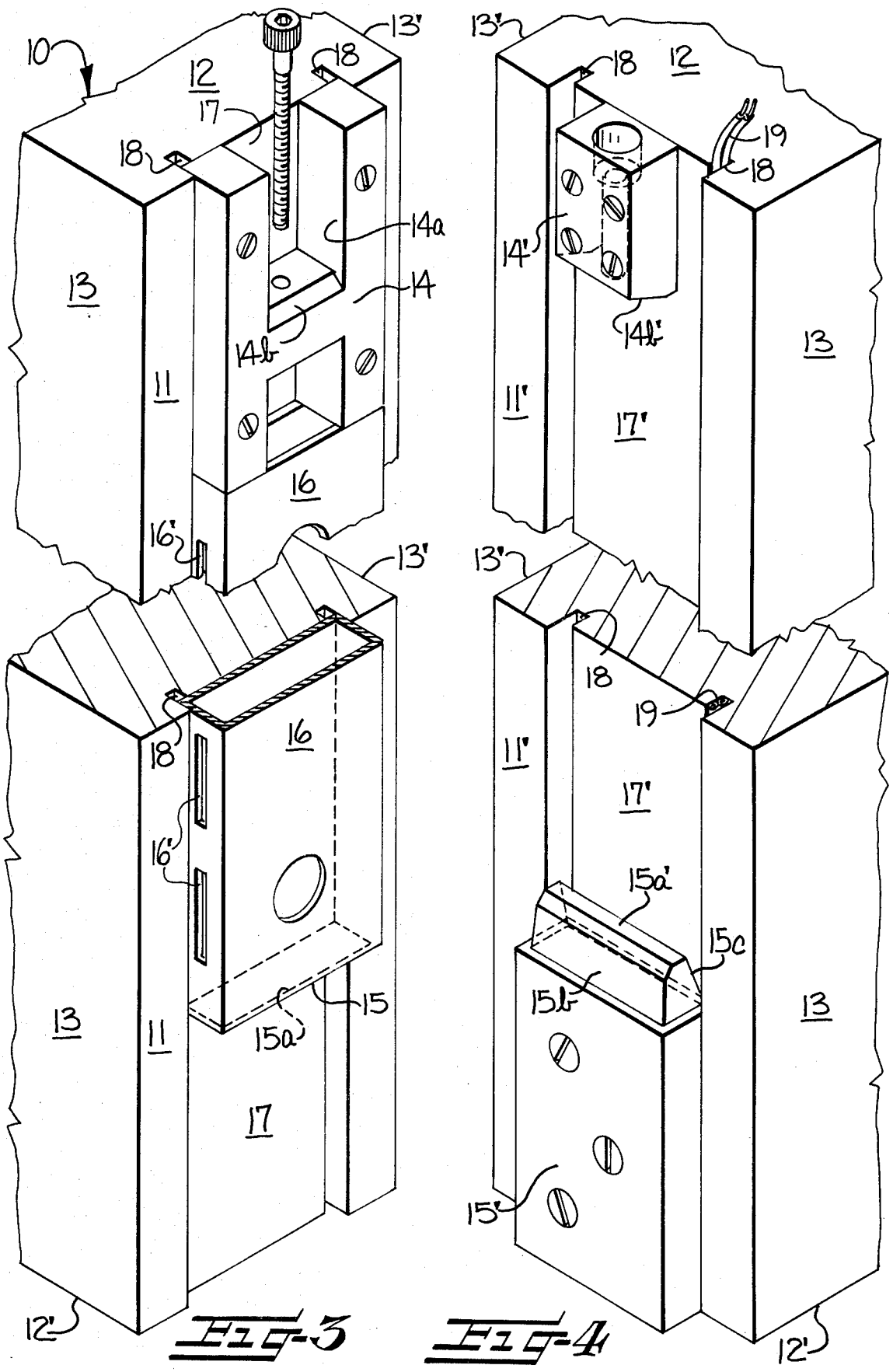
FIG. 3 is a fragmentary exploded isometric view showing one end of the wall panel of the invention.
FIG. 4 is a fragmentary isometric view showing an end of the wall panel of the invention opposite to the end shown in FIG. 3.
Figure 5:
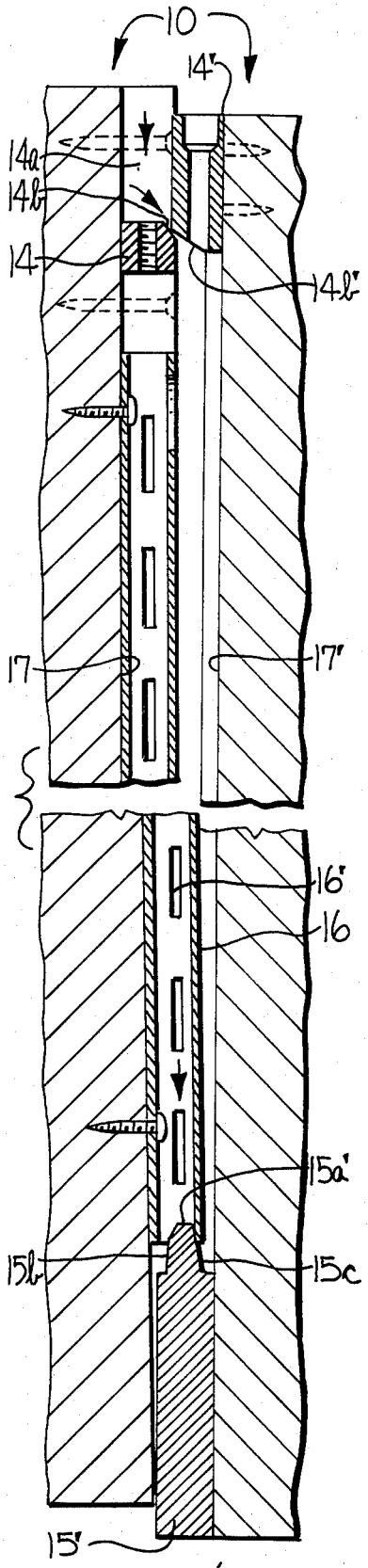
FIG. 5 is a partial longitudinal sectional view showing how the wall panel of the invention is interconnected with a corresponding wall panel.
Figure 6:
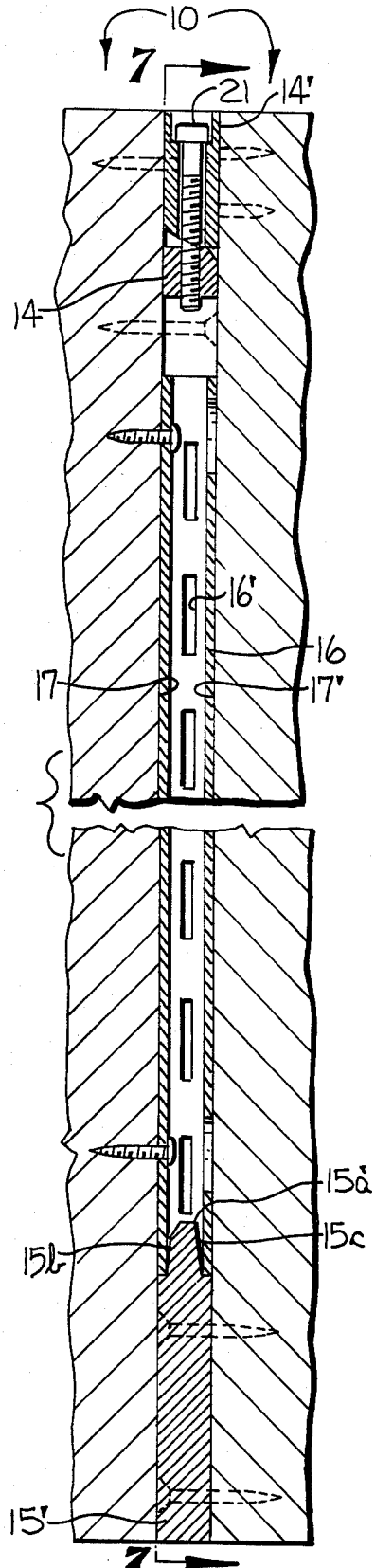
FIG. 6 is another partial longitudinal sectional view showing the wall panel of the invention interconnected with a corresponding wall panel.
Figure 7:
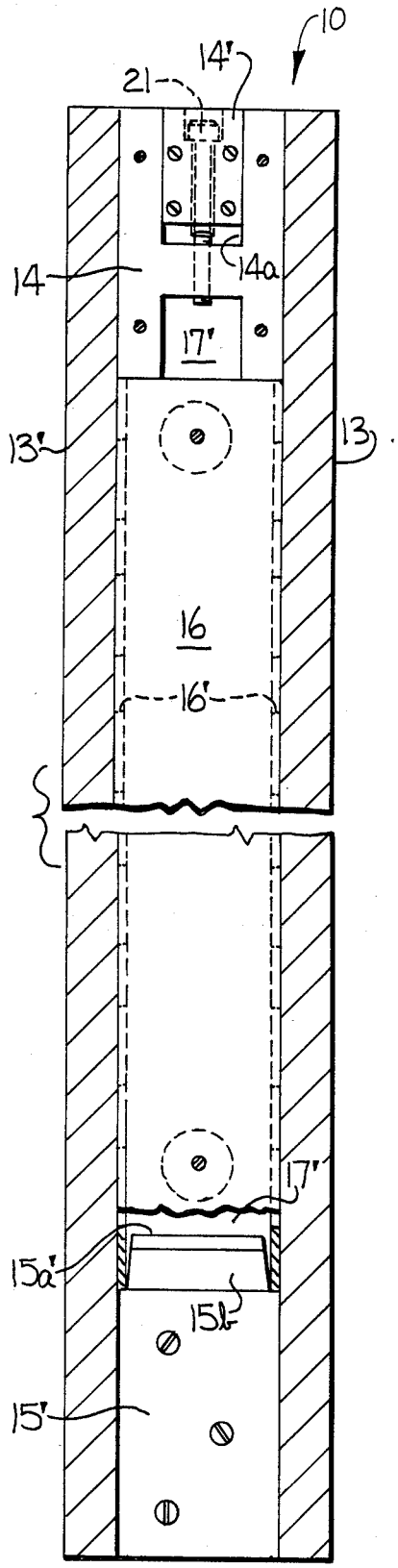
FIG. 7 is a vertical sectional view taken transversely along the line 7—7 in FIG. 6.
Figures 8, 9, 10, 11:
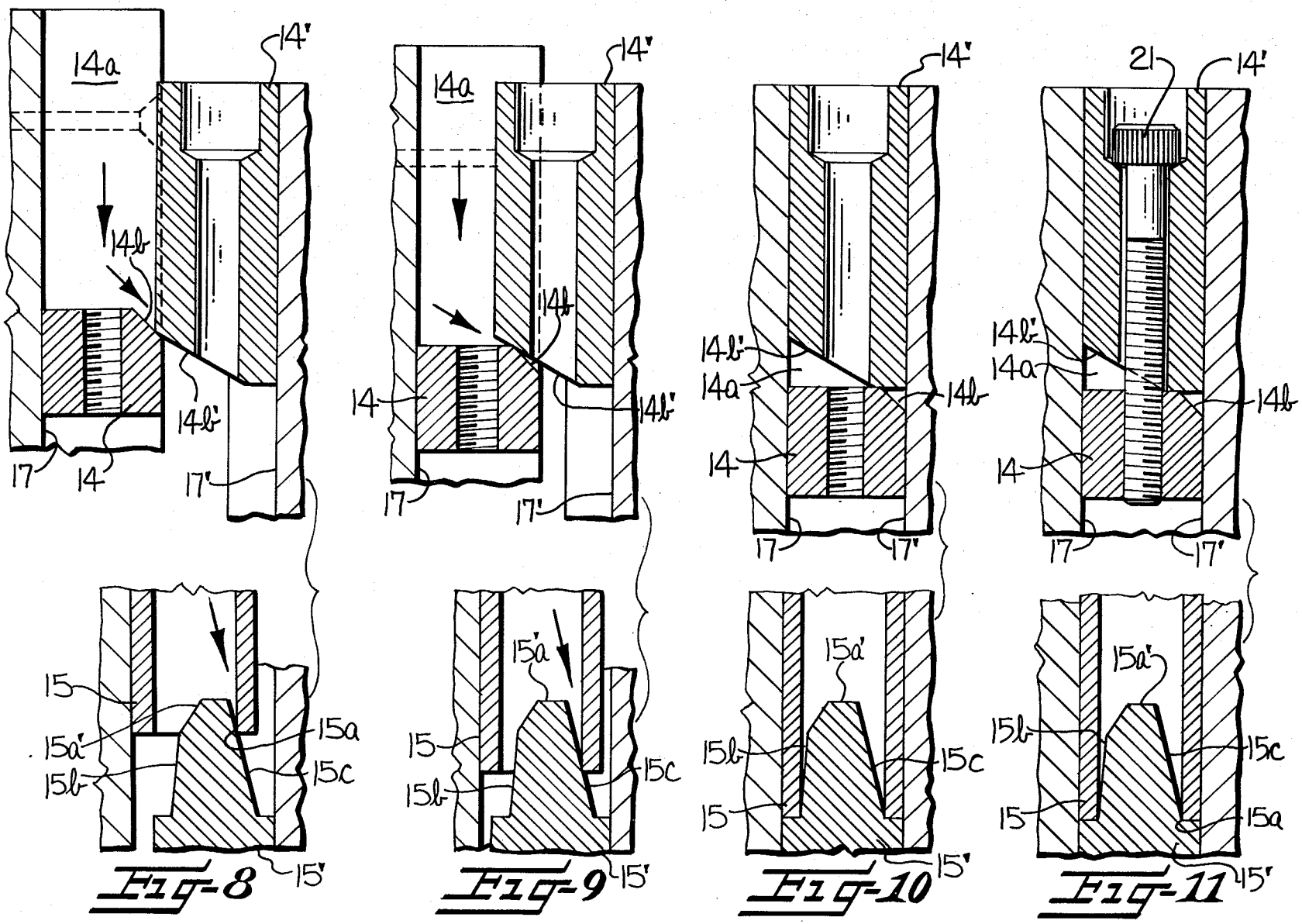
FIG. 8 is a fragmentary longitudinal sectional view expanded from FIG. 5 showing how the upper and lower end connectors of the wall panel of the invention are connected with the mating end connectors of a corresponding wall panel.
FIG. 9 is a fragmentary longitudinal sectional view similar to FIG. 8 showing a further stage of the upper and lower end connectors being connected.
FIG. 10 is a fragmentary longitudinal sectional view similar to FIG. 9 showing the end connectors and panels positioned for being interconnected.
FIG. 11 is a fragmentary longitudinal sectional view similar to FIG. 10 showing the end connectors and panels fully interconnected.

With reference to FIGS. 2 through 4, wall panels 10 of the invention are generally rectangular in shape and have opposing vertical sides 11, 11', opposing horizontal ends 12, 12', and opposing vertical faces 13, 13'. Panels 10 may be solid wood as shown or may be comprised of some of sound absorbing material or may be comprised of wooden or metal frames covered with decorative exterior panels of fabric or other material (not shown). As shown in FIG. 1, wall panels 10 are usually provided with glides G under lower horizontal end 12' for ease in movement over floors and to provide means for panel height adjustment.

Upper connectors 14, 14' and lower connectors 15, 15' carried by each of the vertical sides 11, 11' adjacent the corners of the panel, are utilized to interconnect wall panels 10. Upper connector on one side 11 of panel 10 is a female connector 14 and adapted to interconnect with a male connector 14' on the upper side 11' of an adjacent panel.

Desirably, as shown in detail in FIGS. 3 and 4, the upper and lower female connectors 14, 15 are both carried on a common vertical side 11 of panel 10 and the upper and lower male connectors 14', 15' are both carried on the opposite side 11' of panel 10. While it is not mandatory to have male and female connectors so paired on respective sides, doing so results in panel ends that can be readily identified by sight as male or female and then easily mated with the appropriate vertical side of correspondingly constructed wall panels. FIG. 2 shows adjacent panels 10 positioned for interconnection with corner post 30 which is also provided with appropriate upper connectors 14, 14' and lower connectors 15, 15'.

Upper female connector 14 is desirably "H"-shaped with an upper recess **14*a* dimensioned to closely receive upper male connector 14', which is desirably wedge-shaped as shown. Both upper connectors 14, 14' desirably have tapered bearing surfaces 14*b*, 14*b'* for facilitating the guiding of upper connectors 14, 14' into interconnecting relation. This is shown in FIGS. 5 through 10**.

Lower female connector 15 has an opening **15*a* adapted to closely receive a projecting portion 15*a'* of lower male connector 15. The projecting portion 15*a'* of lower male connector 15 desirably has tapered bearing surfaces 15*b'* and 15*c'* to facilitate the guiding of lower connectors 15, 15' into interconnecting relation as also shown in FIGS. 5 through 10. In the course of interconnection panels 10 are canted at an angle and moved into place as the upper and lower tapered bearing surfaces 14*b*, 14*b'*, 15*b'*, 15*c'***, move over one another.

Adjacent the opening **15*a* formed by the same structure that comprises lower female connector 15 is bracket supporting means 16 having a series of vertically spaced openings 16' therein adapted for selectively receiving a bracket (not shown) therein for mounting the bracket at the desired horizontal level. Such bracket supporting means 16 permit brackets to be supported at various portions of wall construction formed by wall panels 10** such that shelves, cabinets, work surfaces, and other structures may be supported essentially where desired along the wall construction.

This bracket supporting means 16, as shown is thus connected to and carried by vertical side 11 and is spaced inwardly from the top and bottom horizontal ends 12, 12' to permit and accommodate desired placement of the upper connectors 14, 14' and the lower connectors 15, 15'. Although the bracket supporting means 16 may be a separate entity from the lower female connector 15, the hollow metal tube of connector 15 desirably may serve as both and simplify construction. In this form the bracket supporting means 16 has a series of vertically spaced apart openings 16' in those opposite sides directed toward both vertical faces 13, 13' of wall panel 10. This allows brackets to be readily supported on one or both sides of panel 10 for maximum flexibility of panel use.

The upper and lower connectors 14, 15 and 14', 15' on each respective end of the panel are both desirably symmetrically disposed along a vertical line passing through the midpoint of each vertical side 11, 11' so that the opposing vertical faces 13, 13' of adjacent panels 10 when assembled to form a wall are in substantial alignment. This aids in wall panel and wall construction stability as well.

Each vertical side 11, 11' also has a vertical channel 17 running its entire length and centered down each vertical side 11, 11'. Each channel 17 is of generally the same width and of a width generally the same as the width of at least two of the upper and lower connectors 14, 14', 15, 15', and specifically upper and lower female connectors 14, 15 and lower male connector 15' for the embodiment as shown. This arrangement allows those connectors of generally the same width to nest closely in the channels 17 and be snugly secured therein. The channels also aid in obtaining and maintaining the positioned location of the connectors. Also grooves 18 may be provided to run along the sides of the channels 17 and even across the horizontal ends to form recesses or raceways for conductor wire 19.

With further regard to placement of the upper and lower connectors 14, 14', 15, 15', desirably both upper connectors 14, 14' are positioned with their uppermost portions being substantially aligned with the top end 12 of wall panel 10 and with one lower connector 15' being positioned with its lowermost portion being substantially aligned with the bottom end 12' of wall panel 10 so that the opposed horizontal ends 12, 12' of adjacent panels when assembled to form a wall are in substantial horizontal alignment. Also, with the upper and lower connectors so aligned and received by the channels 17 along with the tube portion of lower female connector 15 running therebetween, the horizontal space between adjacent vertical sides 11, 11' is maintained at a minimum and substantially filled with bracket support openings 16.

The upper and lower connectors 14, 14', 15, 15' are firmly secured to vertical sides 11, 11' in substantially permanent fashion, such as with screws, to aid in panel interconnections being rigid and secure.

Means for fastening the upper connectors 14, 14' together are desirably provided which when installed in locked position also serve to interlock the lower connectors 15, 15' and the panels 10 in substantially rigid fashion which is particularly desirable since walls 50 so constructed are usually freestanding and require a maximum of self-support.

One desirable way of accomplishing this fastening involves including openings in the upper connectors 14, 14' in the form of vertical bores 20, 20' and a threaded bore 20 in the female connector 14 to receive a fastening device which may be a bolt or screw. Preferably, a round-headed screw 21 is used having a hexagonal socket in its head (commonly known as an allen screw) and inserted through bore 20' and screwed into threaded bore 20. By being positioned atop panels 10, this fastening may be readily accomplished. Furthermore, use of screw 21 allows adjacent panels 10 to be essentially interconnected by easy hand operation. Final tightening of the screw 21 can also be easily accomplished by hand with the use of a small hexangonal-headed wrench ("allen" wrench) of proper size, and when finally done the screw 21 is essentially hidden from view and contained within a countersunk portion of bore 18'. Notwithstanding the rigid and secure nature of this interconnection and the hidden nature of the fastening means, there is still presented an interconnection that may be readily disconnected without the use of special or power tools, thus allowing interconnected wall constructions to be readily dismantled and interconnected to form new wall arrangements.

In the drawing and specification there have been disclosed typical preferred embodiments of the invention, and although specific terms are employed, they are used in a generic and descriptive sense only and not for purposes of limitation.

That which is claimed is:

1. A wall panel for interconnection with other correspondingly constructed wall panels to form walls of predetermined size and arrangement, said wall panel being generally rectangular in overall shape and having opposing vertical sides, opposing horizontal ends, and opposing vertical faces, upper and lower connectors carried by each of said vertical sides, the upper connector on one side of said panel being a female connector and adapted to interconnect with a male connector on the upper side of an adjacent panel when panels are assembled to form a wall, the upper connector on the opposite side of said panel being a male connector and adapted to interconnect with a female connector on the upper side of an adjacent panel when panels are assembled to form a wall, the lower connector on one side of said panel being a female connector and adapted to interconnect with a male connector on the lower side of an adjacent panel when panels are assembled to form a wall, and the lower connector on the opposite side of said panel being a male connector and adapted to interconnect with a female connector on the lower side of an adjacent panel when panels are assembled to form a wall, each said upper and lower connector on each side of said panel being symmetrically disposed along a vertical line passing through the midpoint of the side of the panel so that the opposing vertical faces of adjacent panels when assembled to form a wall are in substantial alignment.

2. The wall panel of claim 1 wherein the upper and lower connectors on one side of said panel are each female connectors and wherein the upper and lower connectors on the opposite side of said panel are both male connectors such that adjacent wall panels may be readily positioned in the desired orientation and interconnected thereto.

3. The wall panel of claim 1 or 2 including vertical channels of predetermined width along each vertical side, said upper and lower male and female connectors being positioned in said channels with at least two of said connectors having a width generally the same as the width of the channels so that the channels thereby aid in obtaining and maintaining the positional location of said two connectors.

4. The wall panel of claim 3 wherein the upper connectors are placed in the vertical channels with the uppermost portion of at least one upper connector being substantially aligned with the top horizontal end of the wall panel and wherein the lower connectors are placed in the vertical channels with the lowermost portion of at least one lower connector being substantially aligned with the bottom horizontal end of the wall panel so that the opposing horizontal ends of adjacent panels when assembled to form a wall are in substantial alignment.

5. The wall panel of claim 1 or 2 including an elongate vertically arranged bracket supporting means connected to and carried by one of said vertical sides of said panel, said bracket supporting means having a series of vertically spaced openings therein adapted for selectively receiving a bracket therein for mounting the bracket at the desired horizontal level, said bracket supporting means being spaced inwardly from the horizontal ends of said panel, and one end of said bracket supporting means being hollow and serving as one of said female connectors on one side of said panel.

6. The wall panel of claim 5 wherein said bracket supporting means is a hollow rectangular tube with vertically spaced openings in opposite sides of said tube with said tube oriented with the sides of said tube containing the openings parallel to the opposing vertical faces of the wall panel so that brackets may be supported from said wall panel extending from either or both vertical faces thereof.

7. The wall panel of claim 1 or 2 wherein said upper connectors are provided with vertical bores for receiving means for fastening each said upper connector to a connector on the upper side of an adjacent wall panel so as to interconnect said wall panel with adjacent wall panels.

8. A wall panel for interconnection with other correspondingly constructed wall panels to form walls of predetermined size and arrangement, said wall panel being generally rectangular in overall shape and having opposing vertical sides and opposing horizontal ends, upper and lower connectors carried by each of said vertical sides, the upper and lower connectors on one side of said panel each being a female connector and adapted to interconnect with respective male connectors on the upper and lower side of an adjacent panel when panels are assembled to form a wall, and the upper and lower connectors on the opposite side of said panel each being a male connector and adapted to interconnect with respective female connectors on the upper and lower side of an adjacent panel when panels are assembled to form a wall, said upper connectors having vertical openings therein and being adapted to receive fastening means for securing each said upper connector to an upper connector of an adjacent wall panel so as to interconnect the wall panel with adjacent wall panels, and at least one of the upper connectors and at least one of the lower connectors having tapered surfaces for facilitating the guiding of the connectors into interconnecting relation with connectors on adjacent panels when panels are assembled to form a wall.

9. The wall panel of claim 8 including a vertically arranged hollow rectangular tube connected to and carried by one of said vertical sides of said panel, said tube having a series of vertically spaced openings in opposite sides of said tube with said tube oriented with the sides of said tube containing the openings parallel to the opposing vertical faces of the wall panel so that brackets may be supported from said wall panel extending from either or both vertical faces thereof and the lower end of said tube serving as the lower female connector on one side of said panel.

10. A wall construction formed of correspondingly constructed wall panels each wall panel being generally rectangular in overall shape and having opposing vertical sides, opposing horizontal ends and opposing vertical faces therebetween, upper and lower connectors carried by each of said vertical sides, the upper connector on one side of each panel being a female connector, the upper connector on the opposite side of each panel being a male connector, the lower connector on one side of each panel being a female connector, the lower connector on the opposite side of each panel being a male connector, the upper and lower female connectors of each panel interconnecting with male connectors of adjacent panels, the upper and lower male connectors of each panel interconnecting with female connectors of adjacent panels, and fastening means cooperating with said interconnected upper connectors to maintain the panels in their interconnected relationship, said upper and lower connectors on each side of said panels being symmetrically disposed along a vertical line passing through the midpoint of the side of the panel so that the opposing vertical faces of adjacent connected panels are in substantial alignment.

11. The wall construction of claim 10 wherein the upper and lower connectors on one side of said panel are each female connectors and wherein the upper and lower connectors on the opposite side of said panel are both male connectors such that adjacent wall panels may be readily positioned in the desired orientation and interconnected thereto to facilitate formation of the wall construction.

12. The wall construction of claim 11 further comprising an elongate vertically arranged bracket supporting means connected to and carried by the side of said panel carrying the female connectors, said bracket supporting means having a series of vertically spaced openings therein adapted for selectively receiving a bracket therein for mounting the bracket at the desired horizontal level, said bracket supporting means being spaced inwardly from the horizontal ends of said panel, and one end of said bracket supporting means being hollow and serving as the lower said female connector on one side of said panel.

13. The wall panel of claim 12 wherein said bracket supporting means is a hollow rectangular tube with vertically spaced openings in opposite sides of said tube with said tube oriented with the sides of said tube containing the openings parallel to the opposing vertical faces of the wall panel so that brackets may be supported from said wall panel extending from either or both vertical faces thereof.

14. The wall panel of claim 10 or 11 wherein said upper connectors are provided with vertical bores for receiving said fastening means, said fastening means having a threaded end and said vertical bores of adjacent male and female upper connectors of adjacent wall panels being in substantial alignment with the vertical bore of the female upper connector being threaded to receive the threaded end of said fastening means.

* * * * *